United States Patent [19]

Deutsch

[11] 4,175,464

[45] Nov. 27, 1979

[54] MUSICAL TONE GENERATOR WITH TIME VARIANT OVERTONES

[75] Inventor: Ralph Deutsch, Sherman Oaks, Calif.

[73] Assignee: Kawai Musical Instrument Mfg. Co. Ltd., Hamamatsu, Japan

[21] Appl. No.: 866,336

[22] Filed: Jan. 3, 1978

[51] Int. Cl.[2] ..... G10H 1/04; G10H 1/06

[52] U.S. Cl. ..... 84/1.24; 84/1.19

[58] Field of Search ..... 84/1.01, 1.11, 1.12, 84/1.19, 1.21, 1.24; 364/718, 721

[56] References Cited

U.S. PATENT DOCUMENTS

| | | | |
|---|---|---|---|
| 3,831,015 | 8/1974 | Hoff | 364/718 |
| 3,888,153 | 6/1975 | Deutsch | 84/1.01 |
| 4,018,121 | 4/1977 | Chowning | 84/1.01 |
| 4,082,028 | 4/1978 | Deutsch | 84/1.24 |

*Primary Examiner*—Gene Z. Rubinson
*Assistant Examiner*—Forester W. Isen
*Attorney, Agent, or Firm*—Christie, Parker & Hale

[57] ABSTRACT

There is described a tone generator in which waveform amplitude data is generated from a table of sinusoid values in an addressable memory by changing the addresses as a function of time in a periodic or sinusoidal manner. The effect is to produce a sequence of sinusoidal values from the table which correspond to a series of points on a frequency modulated carrier signal. By making the effective modulation frequency equal to the carrier frequency, the resulting frequency modulated signal corresponds to a carrier with side bands that correspond to harmonics of the carrier. The relative amplitudes of these harmonics can be varied as a function of time to produce the sliding formant effect of a synthesizer.

20 Claims, 9 Drawing Figures

0
0
0

MUSICAL TONE GENERATOR WITH TIME VARIANT OVERTONES

FIELD OF THE INVENTION

This invention relates to musical tone generators, and more particularly is concerned with a digital tone synthesizer.

BACKGROUND OF THE INVENTION

It is well known that complex waveshapes of musical tones can be synthesized by combining a plurality of sine waves which are harmonic overtones of a fundamental sine wave. By varying the relative amplitudes of the different harmonic overtones, the tonal quality can be changed. In analog type synthesizers, time variant filters are used to change the tonal structure. Such filters are commonly called "sliding formants". The equivalent of sliding formant filters have also been incorporated in digital tone generators. In general this has required the individual harmonic coefficients to be controlled as a function of time. However, in some types of digital tone generators, such as that described in U.S. Pat. No. 3,315,792, the individual harmonic coefficients are not available in generating the musical tones. Rather, fixed waveshape data is stored in a read-only memory. Even where the harmonic coefficient data is available, modification of this data as a function of time and the calculations necessary to generate the resulting waveshape data can be a complex and time consuming operation.

SUMMARY OF THE INVENTION

The present invention is directed to an improved digital tone generator for obtaining time variant waveshapes which does not require the control of the individual harmonic coefficients. In brief, the system of the present invention creates the overtones by a digital equivalent of frequency modulation in which the modulation side bands are harmonic or non-harmonic overtones of the fundamental (carrier frequency) signal. Thus the present invention employs the known property that the side bands of a frequency modulated carrier form overtones where the fundamental frequency of the tone corresponds to the carrier frequency. The use of frequency modulation techniques for generating musical sounds is described in the article "The Synthesis of Complex Audio Spectral by Means of Frequency Modulation" by J. M. Chowning, J. AUD. ENG. SOC., Vol. 21, No. 7, September 1973, pp 526–534. Also in U.S. Pat. No. 4,018,121—Chowning, there is described a digital system for implementing frequency modulation theory for generation of unique musical sounds.

The general expression for defining a frequency modulated signal is:

$$x(t)=A \sin (2\pi f_c t+M \sin (2\pi f_m t) \quad (1)$$

where $f_c$ is the carrier frequency, $f_m$ is the modulation frequency and M is the modulation index. An exactly equivalent expression to equation 1 is obtained by using the trigonometric cosine functions. It is well known that frequency modulation creates a side-band structure. If, in equation 1, the modulation frequency $f_m$ is made equal to the carrier frequency $f_c$, the resulting signal x(t) will consist of the carrier plus side bands which are harmonically related to the carrier frequency. Other relations between the carrier and modulation frequencies will produce a variety of tonal structures. For example, if $f_m$ is an even multiple of $f_c$, only the odd numbered harmonics will be generated. If $f_m$ is not an integer multiple of $f_c$, the overtones will not be harmonically related to the carrier frequency. This modulation condition can be used to produce audio sounds in which the overtones are not simple harmonics of the fundamental, such as the sounds produced by bells.

In brief, the present invention involves the calculation of digital values corresponding to the amplitudes of a series of points defining an audio waveform using a table of sinusoid or other trigonometric values stores in an addressable memory and reading out the values by addressing the memory in a predetermined manner. Specifically the addresses are determined by generating numbers representing sequential addresses and modifying the addresses by adding to each number a number in a sequence of numbers which vary periodically, such as sinusoidally. The modified addresses are used in sequence to read out the sinusoid values from the table to provide a set of data corresponding to the amplitudes of points defining the waveform. The data is converted to an audio voltage by a digital-to-analog converter.

DESCRIPTION OF THE DRAWINGS

For a better understanding of the invention reference should be made to the accompanying drawings, wherein.

DETAILED DESCRIPTION

The present invention can be applied to various types of digital tone generators or digital tone synthesizers, such as the digital organ described for example in U.S. Pat. No. 3,515,792, the computer organ described in U.S. Pat. No. 3,809,786, or the polyphonic tone synthesizer described in copending application Ser. No. 603,776, filed Aug. 11, 1975 now issued as U.S. Pat. No. 4,085,644, each of which is hereby incorporated by reference.

Figure 1:
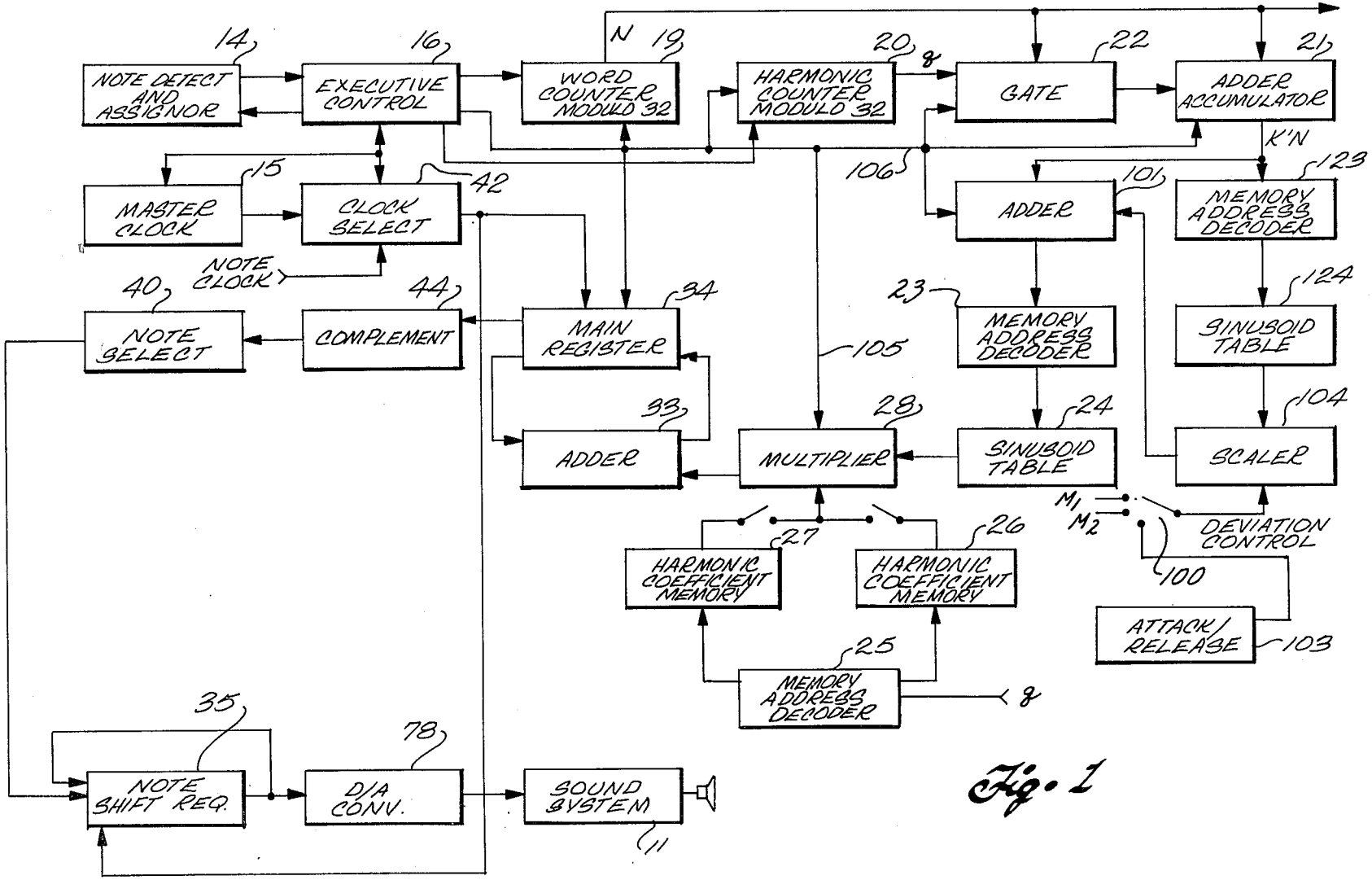
FIG. 1 is a block diagram of a digital tone synthesizer incorporating the present invention.

The present invention as applied to the polyphonic tone synthesizer is shown in the block diagram of FIG. 1. In the polyphonic tone synthesizer, a master data set representing the amplitudes of a series of equally spaced points along one cycle of the waveshape being generated is calculated during a calculation mode. The data set is then transferred to a note shift register 35 from which the amplitude values are shifted out serially at a rate determined by the fundamental frequency of the tone to be generated. The successive digital values of the data set as shifted out are applied to a digital-to-analog converter 78 which produces an analog voltage that varies in amplitude with the changes in the value of the digital data read out of the shift register.

The master data set is generated during the calculation mode, for example, by computing the amplitudes of 32 points comprising one-half cycle of the musical waveform and complementing these 32 values to get an additional 32 points comprising the other half cycle, thus providing 64 amplitude values to the note shift register of the tone generator. Each of the 32 values in the master data set are calculated by summing the amplitudes of the corresponding 32 points of the fundamental and each of the harmonics in conformance with conventional Fourier analysis. Since each harmonic is a sinewave or other orthogonal function, the points in each harmonic are calculated by means of a sinusoid table. The output of the sinusoid table is multiplied by the amplitude coefficient of the particular harmonic as derived from a coefficient table. By selecting different tables of coefficients, the relative amplitude and hence the tonal quality of the resulting audio tone can be controlled.

As shown in more detail in the block diagram of FIG. 1, the polyphonic tone synthesizer as described in the above-identified copending application includes a note detect and assignor circuit 14 which detects when a key on the instrument keyboard has been depressed. The note detector and assignor circuit 14 signals an executive control 16 that the key has been operated and the executive control initiates a computation cycle. The circuit 14 is described in detail in U.S. Pat. No. 4,002,098.

As described in detail in the above-identified application Ser. No. 603,776, a computation cycle is controlled by a word counter 19 which counts to 32 and a harmonic counter 20 which also counts to 32. The executive control 16 advances the harmonic counter each time the word counter is counted to 32 in response to clock pulses from a master clock 15. The output of the harmonic counter 20 is applied through a gate 22 to an adder-accumulator 21 each time the word counter 19 advances one count. The adder-accumulator 21 adds the count condition of the harmonic counter 20 to the accumulated value in the accumulator. Thus the accumulator counts by 1's for the first harmonic, 32 times. It counts by 2's for the second harmonic, counts by 3's for the third harmonic, etc. The output of the accumulator 21 is applied to a memory address decoder 23 to address a set of sinusoid values stored in a table 24. As each sinusoid value is read out of the table 24 it is multiplied by a harmonic coefficient from one of the harmonic coefficient memories, such as indicated at 26 and 27. The harmonic coefficient is addressed in the selected memory by a memory address decoder 25 in response to the count condition of the harmonic counter 20 so that for each harmonic a particular coefficient value is provided. The output of the multiplier 28 is transferred to a main register 34 through an adder 33 which, for each of the 32 sample points of the half-cycle of the audio wave form, adds the amplitude value of each harmonic as it is computed to the sum of the previously calculated harmonic amplitude value. At the completion of the computation cycle, the main register 34 contains 32 words corresponding to the amplitude of 32 equally spaced points comprising a half cycle of the desired waveshape of the tone to be generated. It will be seen that the calculation of 32 points must be repeated 32 times, once for each of the 32 harmonics for which the system is designed. Thus a total of 32×32 multiplications are required to calculate the master data set in the main register 34.

At the completion of the calculation mode, the 32 words are transferred to a note shift register 34 in synchronism with note clock pulses which have a clock frequency determined by the pitch of the actuated key on the keyboard. Once the note shift register 35 is loaded from the Main register 34, the point-by-point amplitude information is shifted serially to a digital-to-analog converter 78 which converts the successive words to an analog voltage having the desired waveshape and frequency. The output of the digital-to-analog converter is applied to a sound system 11 to reproduce the audio tone.

The present invention provides a greatly simplified arrangement for calculating the master data list in the Main register 34, using the theory of frequency modulation discussed above. Equation 1 can be rewritten as a discrete time series in the following form:

$$x_N = A \sin[\pi N/32 + M \sin(\pi N/32)] \text{ where } N = 1,2 \cdots 64 \quad (2)$$

The discrete time series of equation 2 is based on the assumption that the modulation frequency $f_m$ is equal to the carrier frequency $f_c$ and is written for a waveshape having 64 sample points per period. However, because $x_N$ for a sine function has odd symmetry about its mid range of N, only the first 32 values of N need be computed. The remaining 32 values can be obtained by complementing and reversing the order of the first 32 values.

To calculate the 32 values according to equation 2 and to load them in the Main register 34 during the calculation mode, the polyphonic tone synthesizer described above, as shown in FIG. 1, is modified in the following manner. When operating in the FM mode, the sine table 24 is addressed by determining the value of the quantity within the brackets of equation 2 for each value of N and for a given value of M. In response to a signal on line 105 from the Executive control, the output of the addressed information from the sine table 24 is multiplied by a constant value rather than the harmonic coefficients. The address information addressing the sinusoid table 24 is calculated by using the word counter 19 to determine the value of N. The gate 22 is closed by line 106 from the Executive Control and the adder-accumulator 21 is disabled. The output of the word counter 19 in the FM mode is thereby transferred directly through the adder-accumulator 21 to the input of a memory address decoder 123 for addressing a second sinusoid table 124. Like the first sinusoid table 24, the sinusoid table 124 stores the 32 sine values of N/32. The successive sine values read out of the sine table 124 by the word counter 19 are each multiplied by a scale factor M by menas of a scaler 104. The value of M is determined by an input deviation control signal. The deviation control signal can be manually selected from constant values $M_1$, $M_2$, etc., for example, or be derived from the attack/release generator 103 of the polyphonic tone synthesizer by means of a switch 100, thus varying M as a function of time to produce changing tonal effects.

The output of the scaler 104 is added to the value of N from the word counter 19 by means of an adder 101 and applied to the memory address decoder 23 to address the sinusoid table 24. Thus, with each advance of the word counter 19, a sine value is transferred to the Main register 34 corresponding to the value of $x_N$ of equation 2. When N counts to 32, there will be 32 values of x stored in the Main register 34 completing the computation cycle. This provides a master data list for transfer to the Note Shift register 35 in the manner described in the above-identified copending application on the polyphonic tone synthesizer.

The sinusoid table 24 comprises a read-only memory storing values of $\sin[\pi/32\,(N+M')]$ for $0 \leqq N+M' \leqq 32$. The memory address decoder 23 accesses from the table 24 the sine value corresponding to the argument $N+M'$ where $M'$ is equal to $32/\pi M \sin(\pi N/32)$. It may happen that $N+M'$ does not correspond exactly to the address of a stored sine value. However, the decoder 23 rounds off the value $N+M'$ so as to access the closest stored sine value. Of course, the larger the number of sine values in the table, the smaller will be the round-off error in addressing the sine value. Any error resulting from this round-off does not introduce objectionable audible noise since the fundamental frequency is controlled by the shifting rate of the Note Shift register 35. Such error does have the effect of altering slightly the harmonic content and, therefore, of altering tonal quality.

While in the above description, the invention is described in terms of using sine values in the sinusoid tables 24 and 124, it is well known in the mathematical art that for a periodic waveshape, such as that used in musical tones, a generalized harmonic series can be used to represent the waveshape. Such generalized harmonic series includes, in addition to the Fourier series of the type shown in equations 1 and 2, any family of orthogonal functions or orthogonal polynomials. The orthogonal polynomials include the LEGENDRE, GENGENBAUER, JACOBI, and HERMITE polynomials. The orthogonal functions include Walsh, Bessel, as well as the sine, cosine, and trigonometric functions. The term "orthogonal function" is used in the claims as generic to trigonometric functions and orthogonal polynomials.

Figure 2:
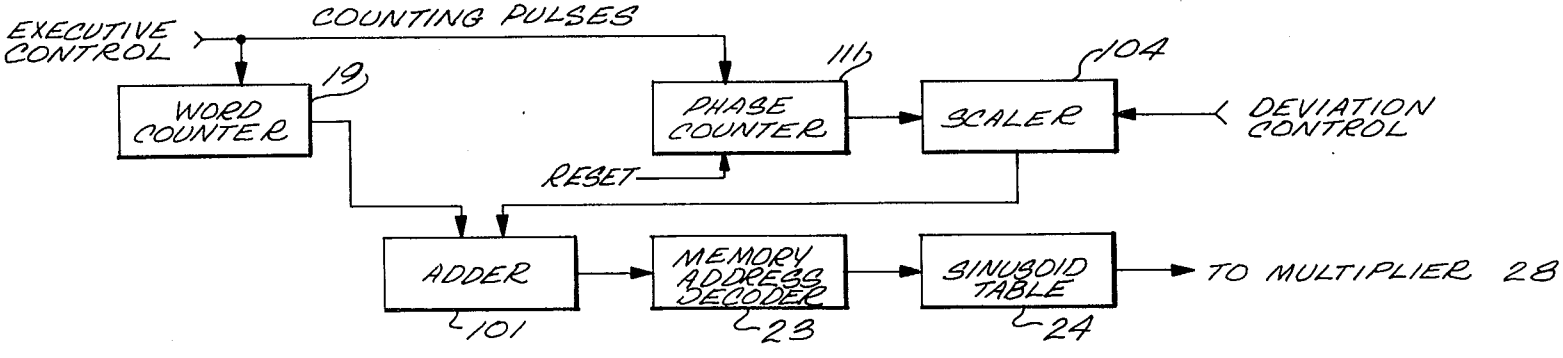
FIG. 2 is a block diagram of a modification to the arrangement of FIG. 1.

It is also known that a periodic triangular wave, particularly if the peaks are truncated, can be used to approximate a sinusoid. Thus, as shown in FIG. 2, an alternative embodiment is to substitute a phase counter 111 for the sinusoid table 124 and memory address decoder 123. The phase counter is counted in synchronism with the word counter 19, but is arranged to count from 1 to 16 and then back to 1 again while the word counter is counting from 1 to 32. The output of the phase counter 111 is then scaled according to the value of M by the scaler 104 and added to the value of N by the adder 101 for addressing the sinusoid table 24.

As described above, equation 2 was written for the case in which the carrier frequency and the modulation frequency are equal. However, other sound effects can be generated by selecting other relationships between the carrier frequency and the modulation frequency. Thus equation 2 can be written in a more generalized form as follows:

$$x_N = A \sin[\pi K'N/32 + M \sin \pi KN/32)] \quad (3)$$

Figure 3:
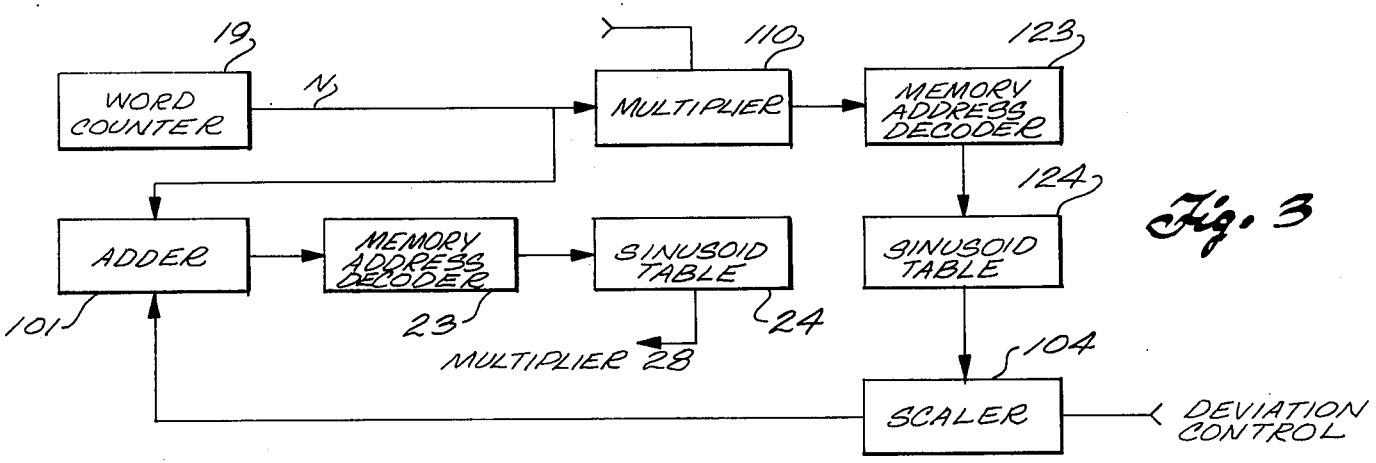
FIG. 3 is a block diagram of a further modification to the arrangement of FIG. 1.

While K is advantageously chosen as an integer it is not so restricted. The effect of changing K is to in effect change the modulating frequency $f_m$ to some multiple of the carrier frequency. For example, if K is selected to have the value 2, the odd harmonics are not generated and the resultant tone has a clarinet-like quality. FIG. 3 shows a modification of FIG. 1 in which a multiplier 110 is provided for multiplying the value of N by the value of K and applying the product to the memory address decoder 123. The value of K may be manually selected, for example, by the musician.

Varying the term K' permits the carrier frequency $f_c$ to be set at selected harmonics of the musical tone, while the modulation frequency is held equal to the fundamental of the musical tone. In such a situation there will be no spectral component at the fundamental frequency; that is, the fundamental pitch is suppressed. While the variation of K' could be implemented in FIG. 1 by multiplying N from the word counter 19 by an integer constant K' before applying it to the input of the adder 101, it is possible to use the harmonic counter 20 and the adder-accumulator 21 to produce integral multiples of K'. The Executive Control 16 causes the harmonic counter 20 to be initialized to the integer value of K'. The output of the harmonic counter 20 is then multipled by N by means of the adder-accumulator 21. Thus the output of the adder-accumulator 21 provides successive values K'N.

Figure 4:
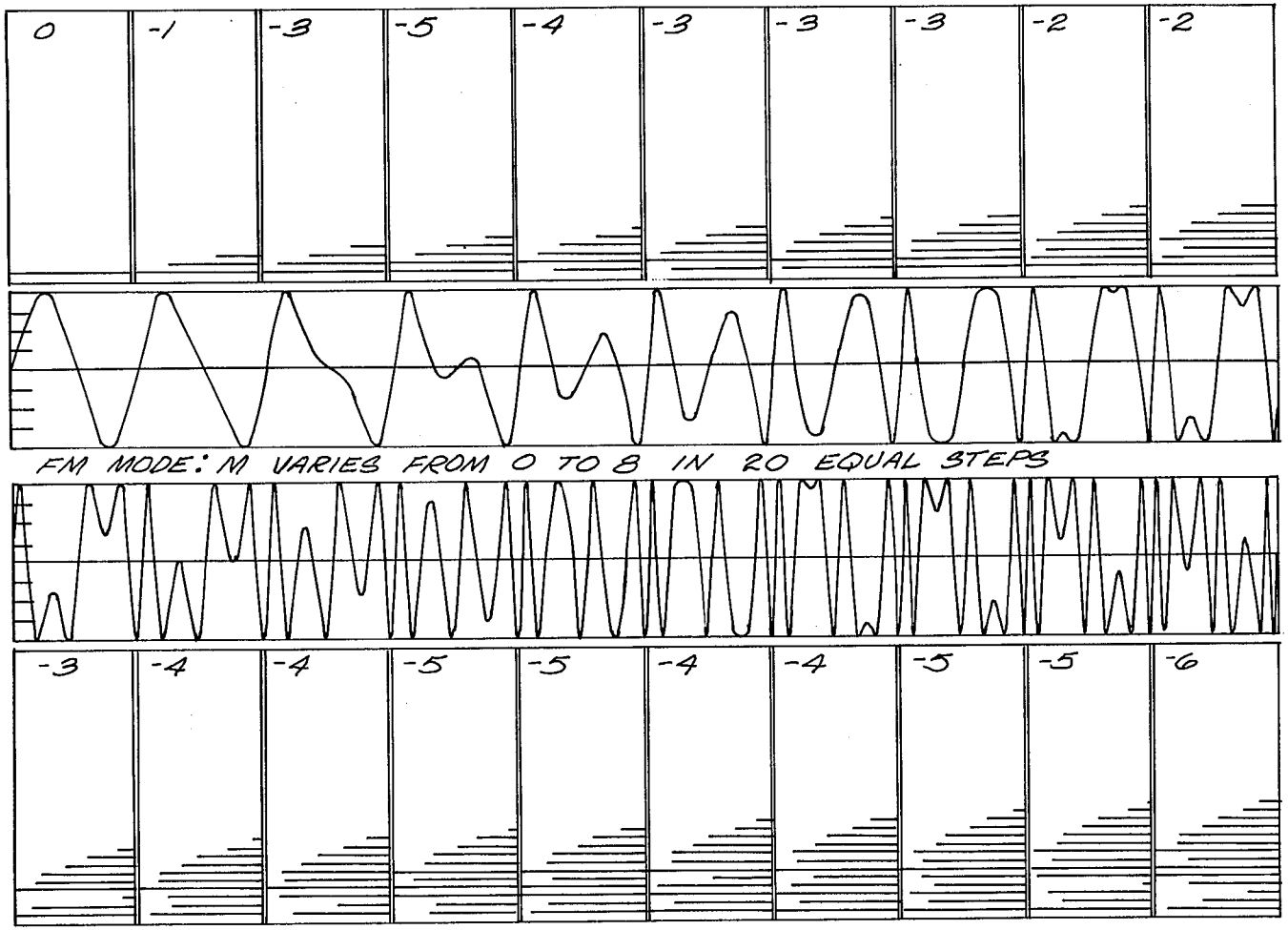
FIGS. 4–6 are waveforms showing the operation of the arrangement of FIG. 1.
Figure 5:
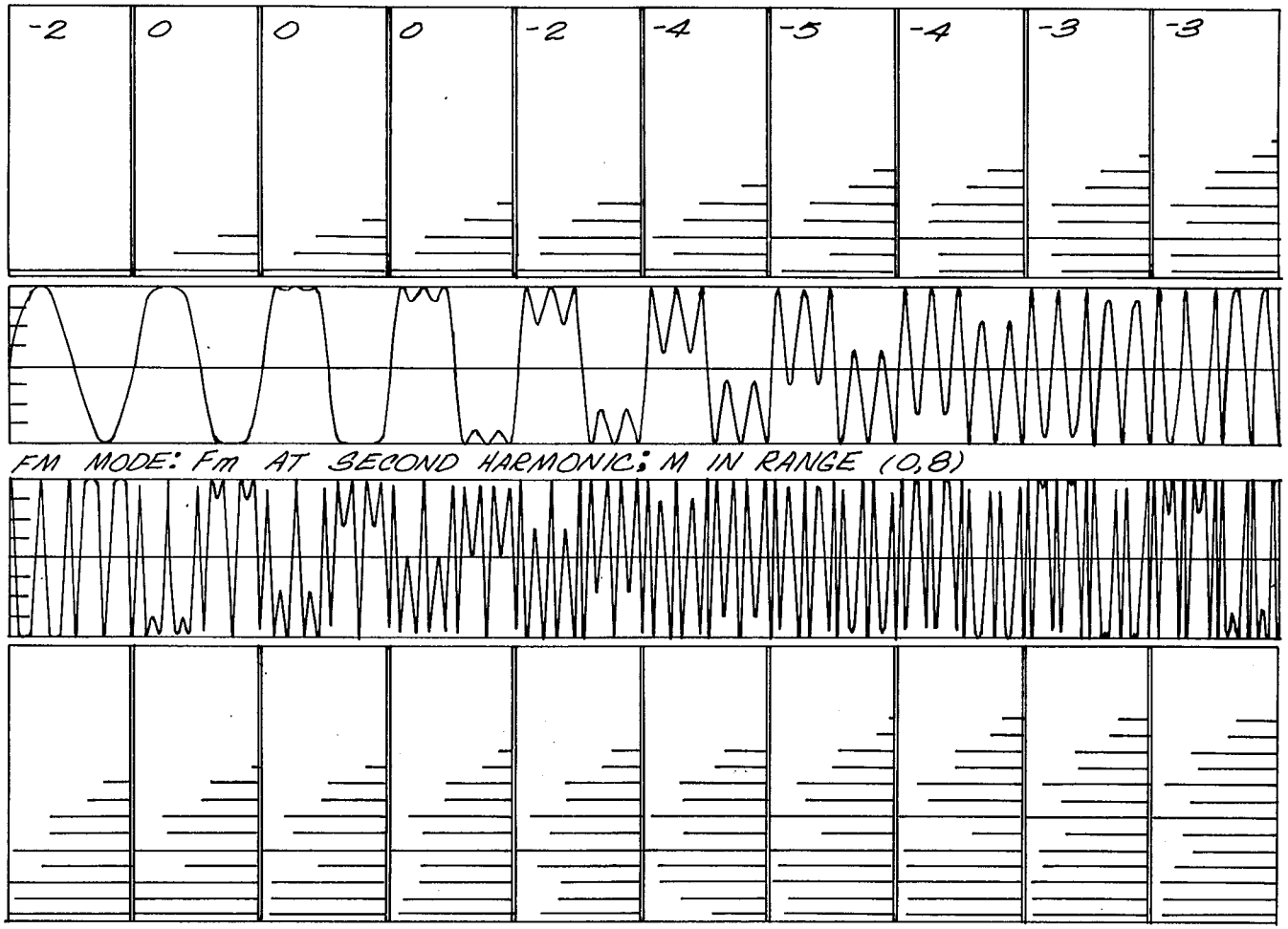
Figure 6:
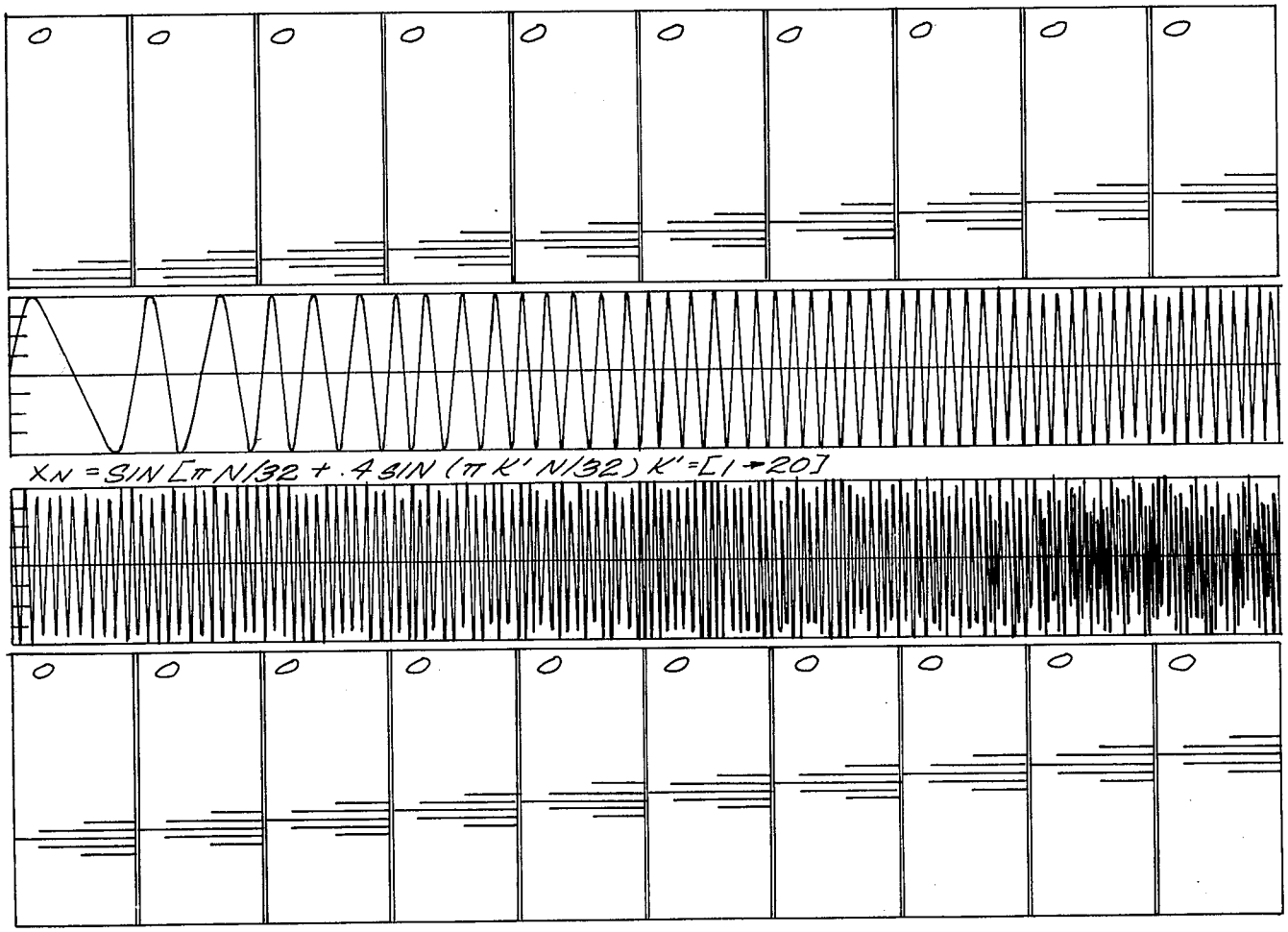

FIG. 4 shows the waveform for successive cycles and the power distribution of the harmonics with K' and K=1, and M varied from 0 to 8. FIG. 5 is similar to FIG. 4 but with K=2. FIG. 6 illustrates the waveforms in which K' is varied in integral steps of 1 through 20 and the modulation index M is equal to 0.4. It will be seen from FIG. 4, that as M is varied, the resulting waveshape varies from a pure sine wave with M=0 to a more complex waveshape with additional harmonics added as M increases in value. FIG. 6 shows that a symmetrical distribution of side bands at the harmonics of the fundamental is produced with the center frequency shifting to one higher harmonic with each increase in the integer value of K'.

Since the master data list formed in the Main Shift register 34 involves an additive process using the adder 33, the output of the sinusoid table can be added to already existing waveform data in the Main register 34, thus providing a master data list which corresponds to the sum of a number of different waveforms. For example, a waveform may be calculated in the manner described in the above-identified copending application by using the sinusoid table 24, multiplier 28, and harmonic coefficient memories 26 and 27. A subsequent calculation can then be made using the FM technique of the present invention and the waveform data resulting from the latter calculation added directly to the waveshape data already stored in the Main register 34. Thus the master data set in the Main register 34 corresponds to the combined waveshapes. Alternatively, the contents of the Main register 34 may be the accumulative results of several FM calculations in which one or the other of the several variables K, K', and M are changed. Using this additive technique, the power in certain higher harmonics can be enhanced relative to the fundamental or intermediate harmonics to produce a resonance effect, also known as the Q-accent effect used in analog-type tone synthesizers.

Figure 7:
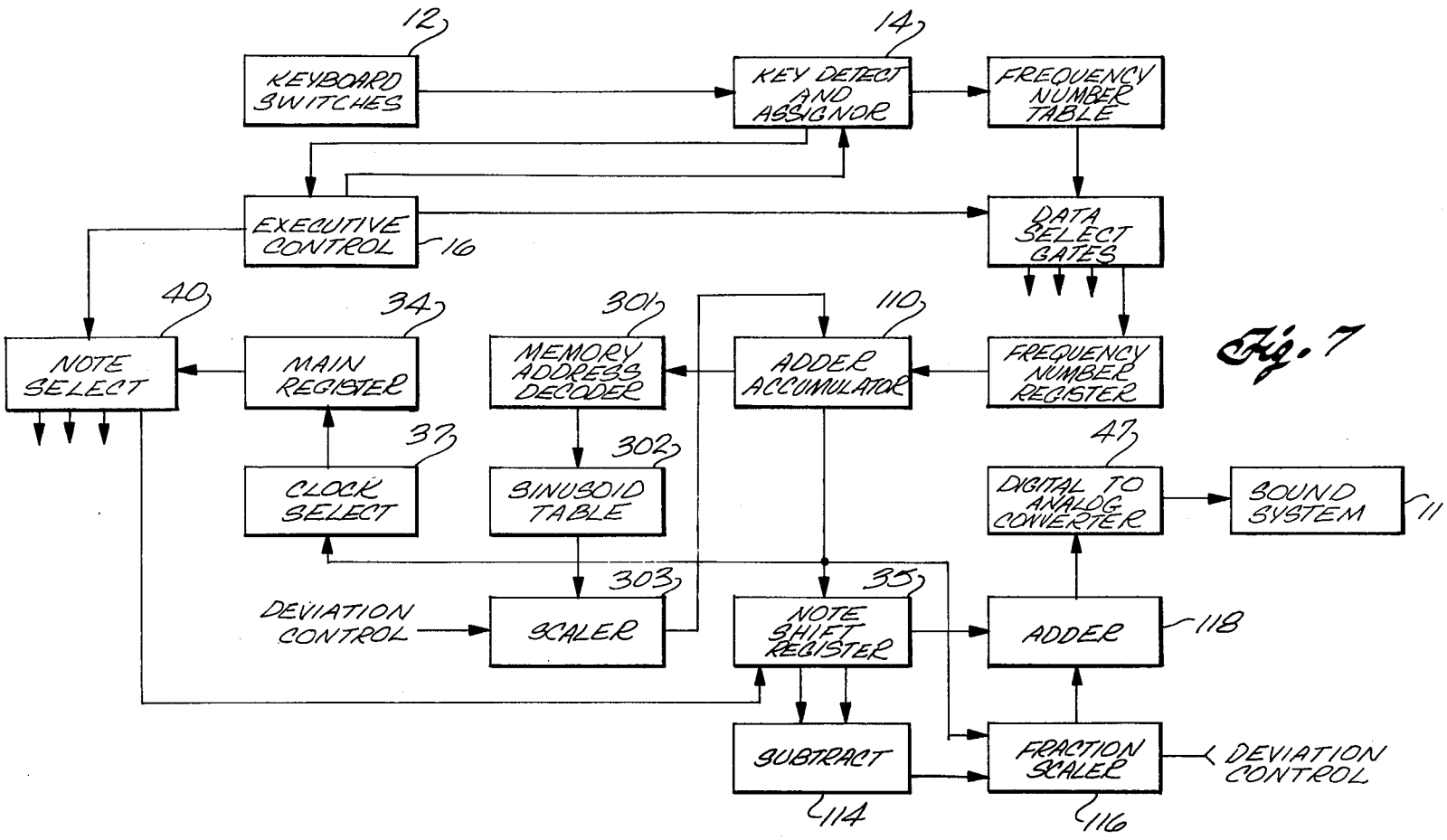
FIG. 7 is a block diagram of a further modification to the arrangement of FIG. 1 for generating a tone with nonharmonic overtones.

Referring to FIG. 7, there is shown a further modification to the polyphonic tone synthesizer arrangement of FIG. 1 which can be used to produce musical tones with non-harmonic overtones. In the arrangement of FIG. 7, the master data set is computed and stored in the Main register 34 in the manner described in copending application Ser. No. 758,010, filed Jan. 10, 1977, and entitled "Note Frequency Generator For A Polyphonic Tone Synthesizer." For the purpose of the present invention, the master data set stored in the main register may correspond to a simple sinewave or may correspond to a more complex waveshape. In application Ser. No. 758,010, hereby incorporated by reference, the master data list is transferred from the Main register 34 to the Note Shift register 35 and from the Note Shift register 35 through an adder 118 to a digital-to-analog converter 47 which produces an analog signal for driving the sound system 11. The Note Shift register 35 is shifted by overflow pulses from an adder accumulator 110 operating as a modulo 1 counter. A frequency number R derived from a frequency number register is added to itself in the accumulator 110, the frequency number always being a number less than 1 and being related to the frequency of the fundamental of the note being generated. When the frequency number R added to itself accumulates to a value greater than 1, an overflow pulse is applied to the Note Shift register 35 to shift the next data sample to the digital-to-analog converter 47. The rate at which the Note Shift register 35 is shifted determines the fundamental frequency of the resulting audio signal from the digital-to-analog converter 47.

According to the present invention, the contents of the adder-accumulator 110 are used to address a sinusoid table 302 by means of a memory address decoder 301. The output of the sinusoid table is scaled in response to the deviation control by an amount M and added to the contents of the accumulator 110. The output of the scaler 303 can be a positive or negative number, thereby acting to increase or decrease the amount by which the adder-accumulator 110 is incremented and thereby changing the time period between overflow pulses. The effect is to modulate the rate at which the Note Shift register 35 is shifted, thereby producing a frequency modulation effect.

The present invention is also useful in a tone system of the type described in U.S. Pat. No. 3,809,786 on a computer organ. The computer organ described in this patent utilizes a tone generator which calculates the amplitude of successive sample points of a musical waveshape in real time using a Fourier type synthesis algorithm. The amplitudes of the points on the waveshape are computed samples $$Z_{qR} = \sum_{n=1}^{W} A_n \sin\left(\frac{\pi\, nqR}{W}\right) q = 1,2 \ldots \quad (4)$$

where W is the number of harmonics and R is a frequency number which determines the spacing of the points along the musical waveshape. Since the sampling rate is fixed, R establishes the fundamental frequency of the generated tone.

In the FM mode of operation according to the present invention, the computer organ is caused to compute data points in real time as expressed by $$Z_{qR} = A \sin[(\pi qR/W) + M \sin(\pi qR/W)];\ q = 1,2, \ldots \quad (5)$$

Figure 8:
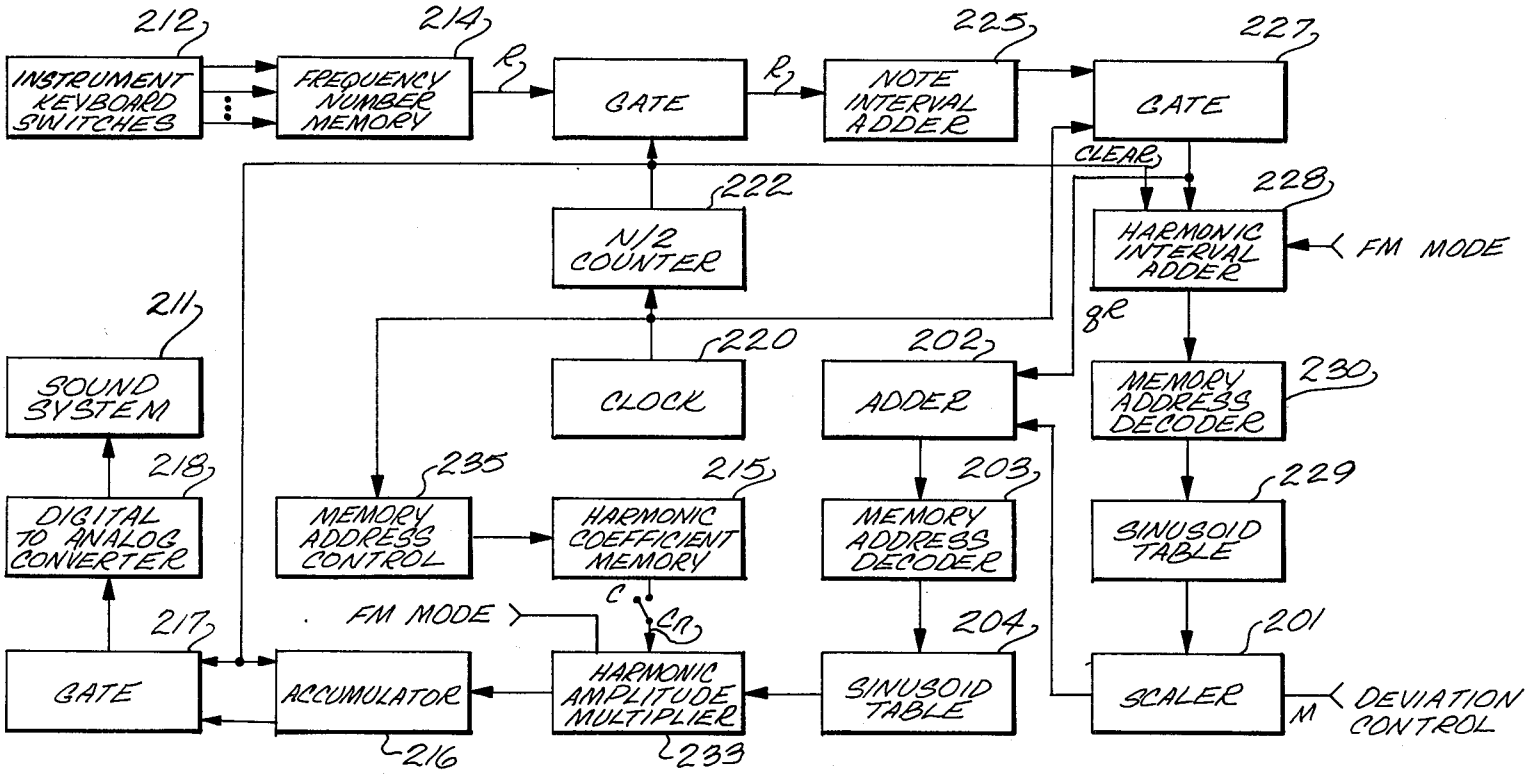
FIG. 8 is a block diagram of a computer organ incorporating the present invention.

Referring to FIG. 8, the block diagram of the computer organ as described in detail in the above-identified U.S. Pat. No. 3,804,786 is shown as modified by the present invention. To operate the computer organ in the FM mode, the harmonic interval adder, indicated at 228, is inhibited or bypassed, as by means of an FM mode control signal. Thus the number qR from the note interval adder 225 is applied directly to the memory address decoder 230 for addressing sinusoid table 229. The output from the sinusoid table, instead of being applied to the harmonic amplitude multiplier 233, is connected in the FM mode of operation to the input of a scaler circuit 201, the scale factor of which is controlled by a deviation control input signal M. The deviation control signal corresponds to the modulation index factor M and the output of the sinusoid table is the sin ($\pi$qR/W). Thus the scaler 201 multiplies the sinusoid value by the modulation index. The output of the scaler is applied to an adder 202 which adds it to the value qR. The sum from the adder 202 is applied to a memory decoder 203 for addressing a second sinusoid table 204. Thus the value $$\sin[(\pi qR/W) + M \sin(\pi qR/W)] \quad (6)$$

is read from the sinusoid table 204 and applied to the accumulator 216 through the multiplier 233 in the computer organ. Input to the multiplier from the harmonic coefficient memory 215 is replaced when operating in the FM mode by a constant multiplier factor at the other input to the multiplier 233. The arrangement of FIG. 8 of course can be modified in the same manner as described above in connection with FIGS. 2 and 3 so that the modulating frequency can be a multiple K of the carrier frequency and a triangular wave generator can be substituted for the sinusoid table 229. It should be noted that in the arrangement of FIG. 8, the modulating frequency can be made a non-integer multiple of the carrier frequency, resulting in an overtone structure which is not harmonically related to the fundamental or carrier frequency. Such non-harmonic overtones can be used to simulate percussive sounds, such as bell-like or drum-like tones. Thus the computer organ if modified to include a multiplier can be converted to the output of the memory address decoder 230 for multiplying the input to the memory address 130 by a factor K. Similarly a multiplier can be used to multiply the input qR to the adder 202 by the factor K', allowing the carrier frequency to be changed relative to the fundamental frequency in the same manner described above in connection with FIG. 1.

Figure 9:
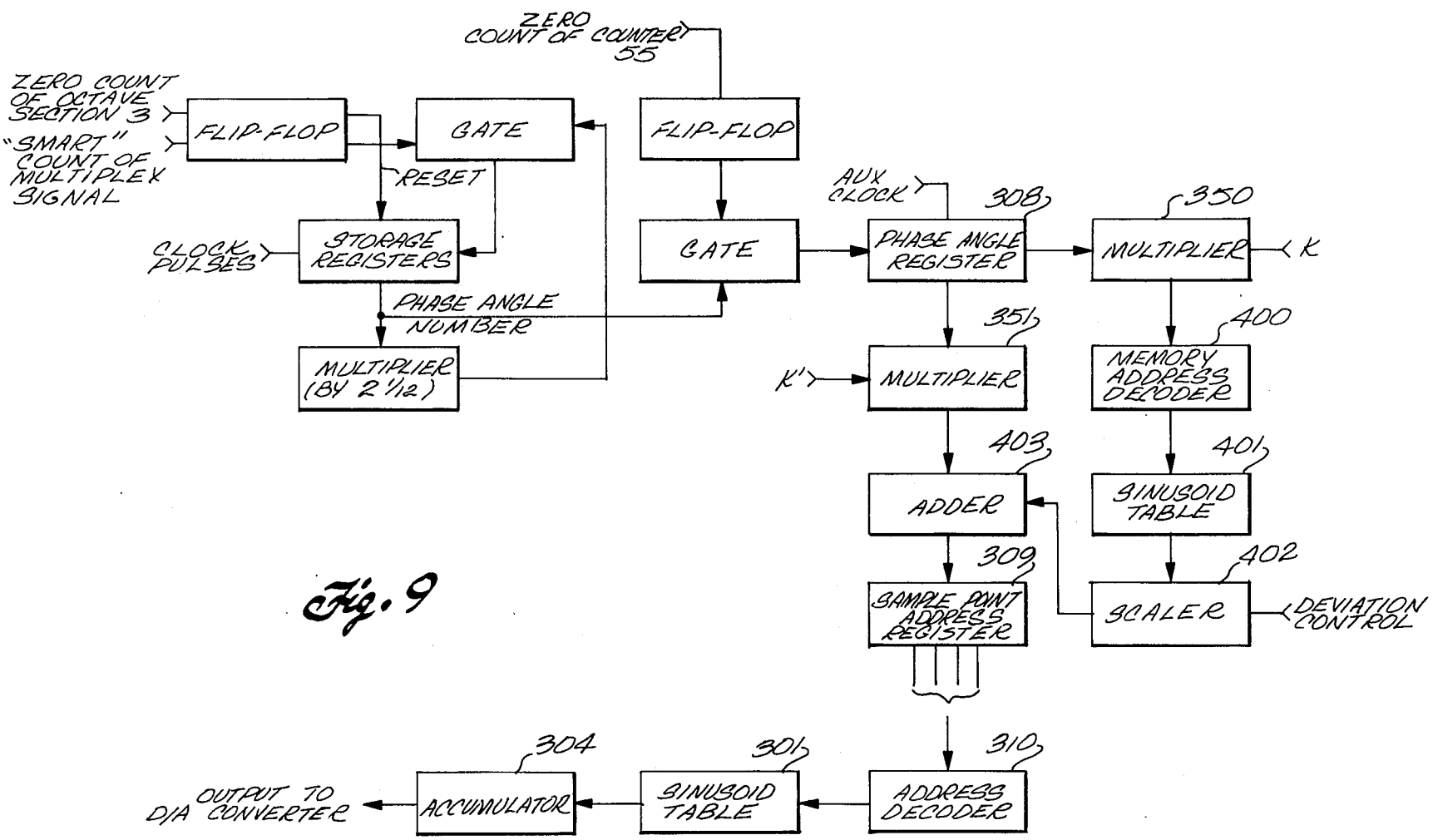
FIG. 9 is a partial block diagram of a digital organ incorporating the present invention.

The present invention may also be incorporated in a digital organ of the type described in more detail in U.S. Pat. No. 3,515,792 as modified by the memory addressing system described in U.S. Pat. No. 3,743,755. FIG. 9 shows an FM modulation system incorporated into the memory addressing subsystem used in this arrangement. The output of the phase angle register 308 instead of being connected directly to the sample point address register 309, as described in U.S. Pat. No. 3,743,755, is connected through a multiplier 351 to one input of an adder 403. The output of the adder 403 then is applied to the sample point address register 309. The multiplier 351 multiplies the output of the phase angle register by the factor K' to vary the carrier frequency in the manner described above. The output of the phase angle register 308 is also applied through a multiplier 350 to a memory address decoder 400 for addressing a sinusoid table 401. The sine value read out of the sinusoid table is connected through a scaler 402 to the other input of the adder 403. The scaler 402 multiplies the sine value by the index coefficient M in response to a deviation control signal which may be either a constant or a variable signal, as described above in connection with FIG. 1. The multiplier 105 multiplies the output of the phase angle register by a value K to vary the modulation frequency in the manner described above.

The output of the adder 403 is stored in the sample point address register 309 and used to address a sinusoid table in the read-only memory 301 by means of an address decoder 310. Sinusoid values read out of the memory 301 are stored in an accumulator 304 from which they are shifted out to the digital-to-analog converter in the manner described in detail in the above-identified U.S. Pat. No. 3,743,755.

From the above description, it will be seen that complex musical waveshapes can be generated digitally by utilizing the concept of frequency modulation. The invention can be implemented in existing digital tone generators and results in a simplified circuit which does not require the generation and control of individual harmonic overtones. The tonal characteristics can be changed as a function of time by varying the modulation index, thus providing the effect of formant filters used in conventional tone synthesizers.

What is claimed is:

1. A musical tone generator for generating a voltage having a waveform corresponding to musical sounds having overtones that can be varied with time, comprising: a first addressable storage means for storing in predetermined addressable sequence a plurality of orthogonal function values, address generating means generating a series of numerical addresses corresponding to said predetermined addressable sequence, means synchronized with said address generating means for generating a sequence of numbers, a different number for each numerical address from said address generating means, the succession of numbers alternately increasing and then decreasing in value in a periodic manner, scaler means for scaling said sequence of numbers by a predetermined scale factor, means including an adder connected to the output of the means generating addresses and the scaler means for adding the scaled numbers to the numerical addresses for addressing said storage means in response to each sequential address modified by a scaled number and reading out the respective orthogonal function values, and means for converting each of said orthogonal function values to a voltage which varies in amplitude in proportion to changes in said orthogonal function values as they are read out of the storage means in response to the addresses from the adder.

2. Apparatus of claim 1 wherein said scaling means includes means for changing the scale factor of said scaling means as a function of time.

3. Apparatus of claim 1 wherein said means generating a sequence of numbers includes second addressable storage means, the second storage means storing a table or orthogonal function values, means for addressing the second storage means from said means generating numerical addresses, said scaler means applying a scale factor to the output from said table.

4. Apparatus of claim 1 wherein said means generating a sequence of numbers includes an up-down counter.

5. Apparatus of claim 3 further including means for multiplying the address of the second addressable means by a predetermined value.

6. Apparatus of claim 3 further including means multiplying the output of the address generating means as applied to the input of the adder by a predetermined value.

7. A keyboard-type polyphonic tone synthesizer in which a master data list is generated in response to operation of a key on the keyboard, the master data list being transferred to a register and repetitively read out of the register at a rate determined by the fundamental frequency of the tone being generated to means for converting the data list to an audio signal, apparatus for generating the master data list comprising: first addressable storage means storing a table of sinusoid values in a predetermined sequence of addresses, means responsive to actuation of a key on the keyboard for generating said predetermined sequence of addresses, means for modifying each of said addresses from the address generating means including second addressable storage means storing a table of sinusoid values, means addressing and reading out the sinusoid values in sequence from said second addressable storage means in response to said sequence of addresses, adder means adding each of the sinusoid values as read out from said second storage means to the corresponding address of said predetermined sequence of addresses to provide a sequence of modified addresses, means responsive to said modified addresses for addressing and reading out sinusoid values from said first addressable storage means, and storing means receiving the sequence of sinusoid values read out of the first storage means to provide said master data list.

8. Apparatus of claim 7 wherein said storing means comprises an adder-accumulator for adding the sinusoid values read out of the first storage means to data already present in the storing means.

9. Apparatus of claim 7 further comprising scaler means coupled to the output of the second addressable storage means for scaling the sinusoid values read out of the second storage means by a predetermined scale factor.

10. Apparatus of claim 9 further comprising means for varying the scale factor of the scaler means as a function of time.

11. Apparatus of claim 9 further including scaler means coupling the addresses from said means for generating said predetermined sequence of addresses to the second addressable storage means for multiplying the addresses by a predetermined scale factor.

12. Apparatus of claim 11 wherein the scaler multiplies each address by a scale factor of two to suppress the odd harmonics in the resultant musical tone.

13. Apparatus of claim 9 further including scaler means coupling the addresses from said means for generating said predetermined sequence of addresses to said adder means for multiplying the addresses by a predetermined scale factor.

14. Apparatus of claim 8 further including variable scaler means coupled between the output of the second storage means and the adder means for scaling the output from the storage means by a controlled scale factor, and means for varying the scale factor of the scaler means as a function of time.

15. In a keyboard operated organ in which a series of digitally coded values corresponding to the amplitude of sample points of a musical waveform are generated at equal real time intervals and the amplitude values converted to an audio signal, apparatus comprising addressable storage means storing tables of sinusoid values in a predetermined sequence of addresses, address generating means responsive to actuation of a key on the keyboard for generating successive addresses at said real time intervals, the successive addresses increasing by increments determined by the fundamental frequency of the audio signal to be generated, means addressing and reading out a sequence of sinusoid values from the first addressable storage means in response to said successive addresses, adder means for adding each sinusoid value as it is read out of the first addressable memory means to the corresponding address from the address generating means to generate a series of modified addresses, and means addressing and reading out a sequence of sinusoid values from the second addressable storage means in response to the series of modified addresses from the adder means, and means converting the successive sinusoid values from the second addressable storage means to an audio signal.

16. Apparatus of claim 15 further including scaler means coupled to the output of the first storage means for multiplying the sinusoid values as they are read out of the first storage means by a predetermined scale factor.

17. Apparatus of claim 16 further comprising means for varying the scale factor of the scaler means as a function of time.

18. In a musical instrument of the type including a keyboard having a plurality of key-operated switches, a plurality of tone setting stop switches, a means for generating a master data list during a computation cycle and storing said master data set in a first memory means, means for transferring the master data set in first memory means to a second memory means during a transfer cycle, means for repetitively reading out data from second memory means, and means for utilizing data read out from second memory means to create audible musical tones, the improvement for producing musical tones with time variant overtones comprising:

a frequency number memory storing coded frequency numbers corresponding to the fundamental musical note pitches for each one of said plurality of key-operated switches, a frequency number select means responsive to actuation of said key-operated switches for addressing a corresponding frequency number from said frequency number memory, a frequency number register for storing said frequency number addressed by said frequency number select means, an adder-accumulator generating an overflow pulse whenever the accumulator exceeds the capacity of the accumulator, and incrementing means for incrementing said adder-accumulator at a fixed clock rate, the sum of said frequency number contained in said frequency number register and a time varying incremented frequency number thereby producing said time-variant overtones, said means for repetitively reading out data from said second memory means including means responsive to said overflow pulse for shifting the stored data successively from the second memory means to said means for utilizing data.

19. In a musical instrument according to claim 18 wherein said incrementing means further comprises:

apparatus comprising first storage means storing a table of sinusoid values in a predetermined sequence of addresses, memory addressing means responsive to the value in said adder-accumulator whereby a corresponding sinusoid value is addressed from said first storage means, a scaler means responsive to a deviation control signal wherein said sinusoid value addressed by said memory addressing means is scaled in value to create said incremented frequency number.

20. In a musical instrument according to claim 19 wherein said scaler means further comprises:

deviation control means whereby said deviation control signal is caused to change in a time-variant manner.

* * * * *

UNITED STATES PATENT AND TRADEMARK OFFICE

CERTIFICATE OF CORRECTION

PATENT NO. : 4,175,464

DATED : November 27, 1979

INVENTOR(S) : RALPH (nmi) DEUTSCH

It is certified that error appears in the above-identified patent and that said Letters Patent are hereby corrected as shown below:

Column 3, line 32, "4,002,098" should read -- 4,022,098 --.

Column 4, line 56, "menas" should read -- means --.

Column 6, line 27, "0.4" should read -- .4 --.

Signed and Sealed this

*Twenty-second* Day of *April 1980*

[SEAL]

*Attest:*

SIDNEY A. DIAMOND

*Attesting Officer*

*Commissioner of Patents and Trademarks*

Notice of Adverse Decision in Interference

In Interference No. 100,610, involving Patent No. 4,175,464, R. Deutsch, MUSICAL TONE GENERATOR WITH TIME VARIANT OVERTONES, final judgment adverse to the patentee was rendered Apr. 8, 1983, as to claims 1–3, 5, 6, 15, 16 and 17.

[*Official Gazette November 8, 1983.*]